US006899008B2

(12) United States Patent
Breuer

(10) Patent No.: US 6,899,008 B2
(45) Date of Patent: May 31, 2005

(54) GUN BARREL HAVING A MUZZLE BRAKE

(75) Inventor: Heinz-Günter Breuer, Duisburg (DE)

(73) Assignee: Rheinmetall W&M GmbH, Unterluss (DE)

( * ) Notice: Subject to any disclaimer, the term of this patent is extended or adjusted under 35 U.S.C. 154(b) by 60 days.

(21) Appl. No.: 10/369,771

(22) Filed: Feb. 21, 2003

(65) Prior Publication Data

US 2003/0154849 A1 Aug. 21, 2003

(30) Foreign Application Priority Data

Feb. 21, 2002 (DE) ..... 102 07 256

(51) Int. Cl.[7] ..... F41A 21/36

(52) U.S. Cl. ..... 89/14.3; 89/14.2; 89/14.4; 89/14.5

(58) Field of Search ..... 89/14.2, 14.3, 89/14.4, 14.5

(56) References Cited

U.S. PATENT DOCUMENTS

| | | | | | |
|---|---|---|---|---|---|
| 1,487,312 | A | * | 3/1924 | Bull | 89/14.2 |
| 1,939,700 | A | * | 12/1933 | Hofstetter | 89/14.2 |
| 2,656,637 | A | * | 10/1953 | Richards | 42/79 |
| 2,712,193 | A | * | 7/1955 | Mathis | 42/79 |
| 2,765,706 | A | * | 10/1956 | Strohl | 89/14.3 |
| 3,367,055 | A | * | 2/1968 | Powell | 42/79 |
| 3,858,481 | A | * | 1/1975 | Elliott | 89/14.3 |
| 4,207,799 | A | * | 6/1980 | Tocco | 89/196 |
| 4,562,767 | A | * | 1/1986 | Janssen et al. | 89/14.3 |
| 4,879,942 | A | * | 11/1989 | Cave | 89/14.3 |
| 5,036,747 | A | | 8/1991 | McClain, III | |
| 5,279,200 | A | * | 1/1994 | Rose | 89/14.3 |
| 5,333,529 | A | * | 8/1994 | Brockman | 89/14.3 |
| 5,367,940 | A | * | 11/1994 | Taylor | 89/14.3 |
| 5,425,298 | A | * | 6/1995 | Coburn | 89/14.3 |
| 5,463,930 | A | * | 11/1995 | Bisping et al. | 89/29 |
| 5,811,714 | A | | 9/1998 | Hull et al. | |
| 5,814,757 | A | * | 9/1998 | Buss | 89/14.3 |
| 6,425,310 | B1 | * | 7/2002 | Champion | 89/14.3 |
| 6,604,445 | B2 | * | 8/2003 | Sevastian | 89/14.3 |

FOREIGN PATENT DOCUMENTS

| | | | |
|---|---|---|---|
| CH | 0008453 | * | 3/1894 |
| EP | 0 085 754 B1 | | 5/1986 |
| FR | 2 718 839 | | 10/1995 |

OTHER PUBLICATIONS

"Rückstossbremsung bei Geschützen", Oct. 1981, p. 6917.

* cited by examiner

*Primary Examiner*—Jack Keith
*Assistant Examiner*—John Richardson
(74) *Attorney, Agent, or Firm*—Venable LLP; Stuart I. Smith

(57) ABSTRACT

A gun barrel having a muzzle brake (2), especially for large-caliber guns, in which the muzzle brake (2) includes a tubular piece that has openings (16) around its circumference, and a jacket tube (4), which surrounds the tubular piece and has diametrically opposite gas-exit openings (17) that extend perpendicular to the bore longitudinal axis (15). To provide an arrangement comprising a barrel (1) and a muzzle brake (2) that minimizes the firing stresses on the parts of the muzzle brake (2) that are detachably connected to the barrel (1), the muzzle region (3) of the barrel (1) itself is used as a component of the muzzle brake (2. That is, the muzzle region of the barrel is provided with a plurality of openings (16) arranged in ring formation around the barrel (1), and the attached the jacket tube (4) is provided with slot-shaped gas-exit openings (17) over this muzzle region (3).

18 Claims, 2 Drawing Sheets

Fig.2
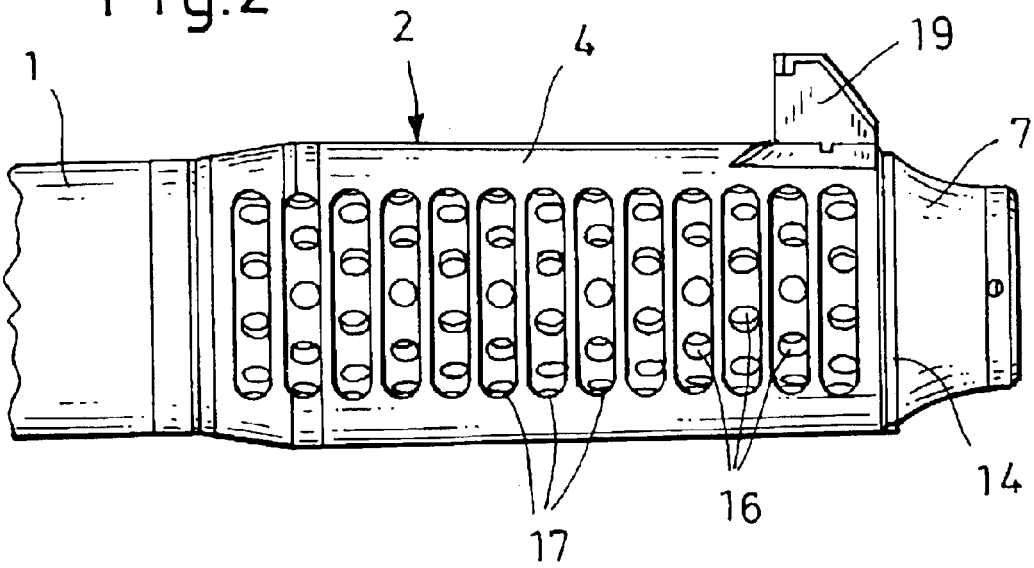
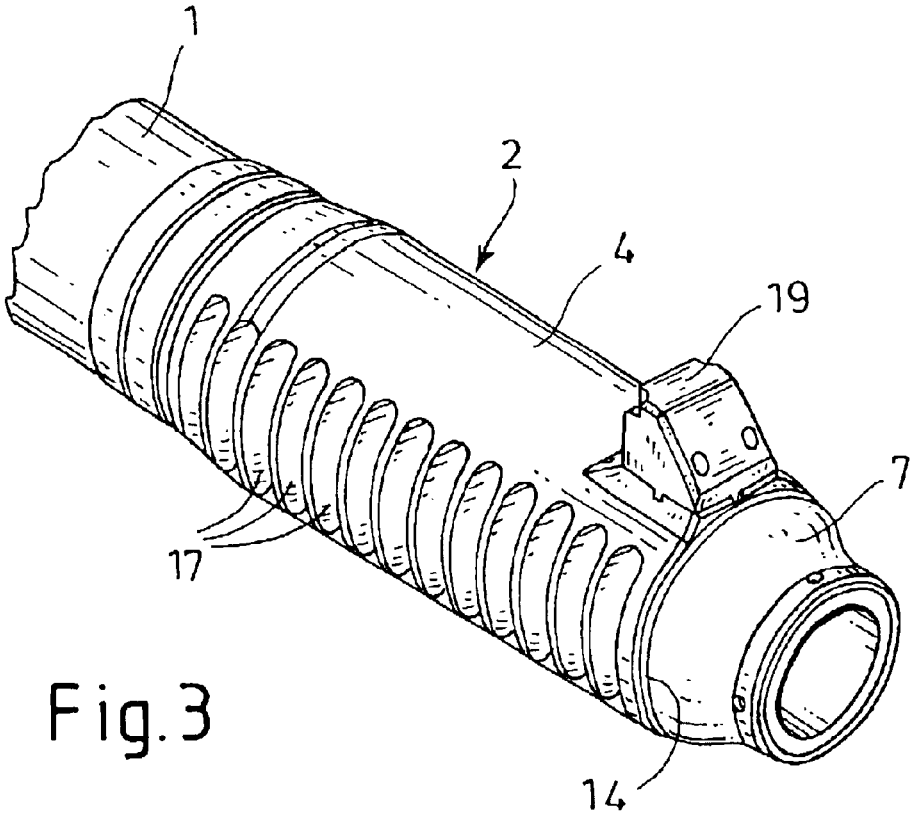
Fig.3

GUN BARREL HAVING A MUZZLE BRAKE

CROSS REFERENCE TO RELATED APPLICATION

This application claims the priority of German Patent Application DE 102 07 256.6 filed Feb. 21, 2002 which is incorporated herein by reference.

BACKGROUND OF THE INVENTION

The invention relates to a gun barrel having a muzzle brake, especially for large-caliber guns.

European Patent EP 0 085 754 B1 discloses a gun barrel in which a separate muzzle brake is attached to the muzzle end of the barrel in order to reduce the recoil energy. The muzzle brake includes a tubular piece that ends flush with the barrel and has radial bores around its circumference, with the inside diameter of the tube being identical to the caliber. The brake further includes a jacket tube, which has diametrically opposite gas-exit openings that extend perpendicular to the longitudinal axis of the bore.

A drawback associated with this known arrangement is that the use of such muzzle brakes dictates a complicated machining of the respective gun muzzle, because relatively high stresses (high acceleration forces, high tensile forces due to the braking effect) act on the muzzle brake when the gun is fired, so the threaded connection that fixes the muzzle brake to the gun barrel must be designed with these stresses in mind. It is also necessary to machine the muzzle brake to attain a smooth transition for the projectile between the caliber diameter of the barrel and that of the muzzle brake. This is especially the case for rifled barrels, in which a smooth transition must be additionally assured between the rifling-field profiles of the barrel and the muzzle brake.

SUMMARY OF THE INVENTION

It is the object of the invention to provide an arrangement comprising a gun barrel and a muzzle brake, in which, during firing, no high stresses comparable to those in the known barrels are exerted on the parts of the muzzle brake that are detachably connected to the barrel.

This object generally is achieved according to the present invention which is essentially based on the concept of embodying the muzzle-side end of the gun barrel itself as a component of the muzzle brake. This end is provided with a plurality of bores that are disposed in ring formation around the barrel. The jacket tube, which has diametrically opposite gas-exit openings that extend slot-like in the direction of the circumference, is attached over this muzzle-side barrel segment.

The jacket tube has a plurality of circular-ring-shaped grooves in its inside surface, which respectively end in the opposite, slot-shaped gas-exit openings, and terminate into openings of the barrel that lie in one plane.

Because up to 80% of the braking forces are transmitted directly to the barrel in the barrel/muzzle brake arrangement of the invention during firing, and only about 20% of the braking forces must be transmitted from the jacket tube to the barrel, the jacket tube and the corresponding fastening thread, etc., can be significantly smaller than in comparable gun-barrel arrangements having a completely separate muzzle brake. The arrangement of the invention therefore also has a lower weight than comparable, known arrangements.

A further distinguishing feature of the barrel/muzzle brake arrangement according to the invention is that the muzzle of the barrel can be machined very easily. The arrangement further ensures that projectiles pass smoothly through the region of the muzzle brake, and there is no negative influence on the jump-error angle, which guarantees a high hitting accuracy.

The axially adjacent openings of the barrel in the muzzle region are preferably offset from one another. This takes into account the stability requirements on the barrel, on the one hand, and assures the unimpeded passage of projectiles in this barrel region, on the other.

The cross-sections of the barrel openings in the muzzle region can be circular, slot-shaped or polygonal.

The size, shape and number of the openings, and the positions of the openings in the muzzle region of the barrel with respect to the bore longitudinal axis (radial or angled), depend on the desired effect of the muzzle brake.

Further details about and advantages of the invention ensue from the following exemplary embodiments explained in conjunction with drawing figures.

BRIEF DESCRIPTION OF THE DRAWINGS

FIG. 2 is a side view of the barrel shown in FIG. 1.

FIG. 3 is a perspective view of the barrel shown in FIG. 1.

DETAILED DESCRIPTION OF THE INVENTION

Figure 1:
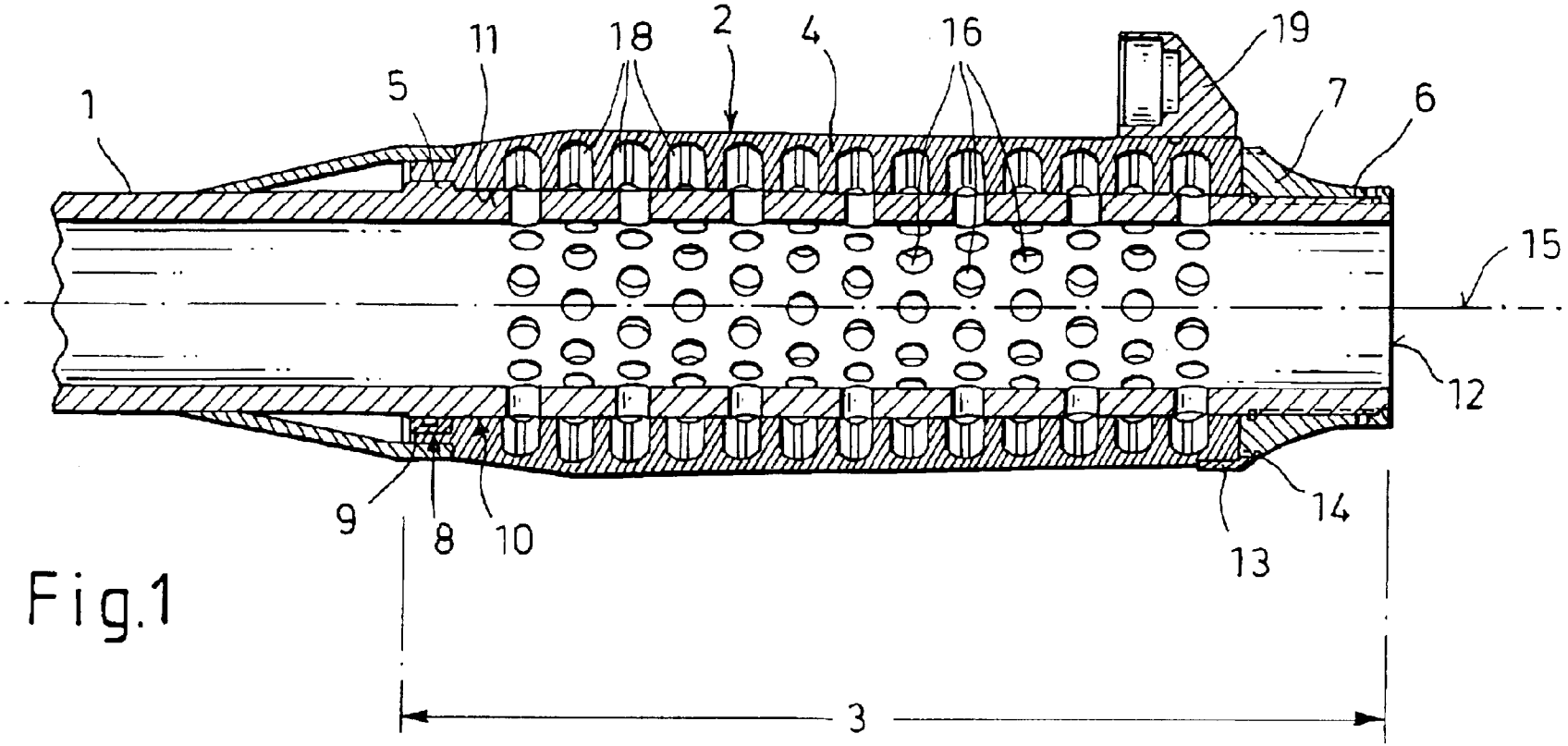
FIG. 1 is a longitudinal section through the muzzle-side region of a gun barrel having a muzzle brake according to the invention.

FIGS. 1 through 3 depict a large-caliber gun barrel 1 of a tank gun, which is provided on the front with a muzzle brake 2. The muzzle brake 2 encompasses the muzzle region 3 of the barrel 1 and a jacket tube 4 that is disposed over the muzzle region 3 and is supported at the rear against an annular stop 5 of the barrel 1, and is held at the front by a screw ring 7 that can be screwed onto a thread 6 on the outer surface of the barrel 1.

To secure the jacket tube 4 against rotating, a spline and keyway connection 8 is provided and includes a longitudinally extending spline or key 9 disposed in the jacket tube 4. This spline or key 9 extends into a groove, not shown, in the annular stop 5 of the barrel 1.

To assure fast assembly and a secure seating of the jacket tube 4 on the barrel 1, the outside surface 10 of the barrel 1 and the inside surface 11 of the jacket tube 4 taper slightly in conical fashion toward the muzzle 12 of the barrel 1.

A securing piece 13, which extends in a form-fit into a serration 14 of the screw ring 7 and secures the ring 13 against loosening, is secured to the front of the jacket tube 4.

In the muzzle region 3 of the barrel 1, radial bores 16 are provided in a plurality of planes that are disposed one behind the other in the longitudinal direction and extend perpendicular to the bore longitudinal axis 15 of the barrel 1. The bores 16 in adjacent planes are offset radially from one another.

The jacket tube 4 disposed over the bores 16 of the barrel 1 has a plurality of diametrically opposite gas-exit openings 17, best seen in FIGS. 2 and 3, that extend in a slot shape in the circumferential direction of the jacket tube 4. The number of pairs of openings 17 corresponds to the number of planes for the bores 16. On its inside surface 11, the jacket tube 4 also has a plurality of circular-ring-shaped, circumferential grooves 18, which respectively end in two opposite, slot-shaped gas-exit openings 17. The bores 16 of the barrel 1 that lie in one plane, and do not terminate directly into the gas-exit openings 17, terminate into the respective grooves 18.

The arrangement of the lateral gas-exit openings 17 represents a defined out-flow direction of the released propellant gases. The size and position of the gas-exit openings 17 also influence the size and the region of the exiting propellant gases, and the magnitude and region of the sound pressure.

After a cartridge (not shown) has been ignited, the highly stressed propellant gases following the projectile reach the region of the muzzle brake 2, and travel via the bores 16 (impact surfaces) of the barrel 1 to the walls of the circumferential grooves 18 of the jacket tube 4 (additional impact surfaces), which reduces the barrel-recoil energy.

A muzzle reference system 19 is also attached to the front of the jacket tube 4.

Of course, the invention is not limited to the above-described embodiment. For example, the muzzle-side openings (16) of the barrel need not necessarily be bores as shown, but may be formed as slots.

The invention flow being fully described, in will be apparent to one of ordinary skill in the art that many changes and modifications can be made thereto without departing from the spirit of scope of the invention as set forth herein.

What is claimed is:

1. A gun barrel having a muzzle brake comprising:

a gun barrel having a plurality of openings provided in a muzzle region of the gun barrel with the openings being disposed in a plurality of planes that are disposed one behind the other and extend perpendicular to a bore longitudinal axis of the barrel;

a jacket tube having pairs of diametrically opposite gas-exit openings, which respectively extend, in slot form, in a circumferential direction of the jacket, disposed on an outer surface of the barrel and covering the muzzle region of the barrel having the openings; and a plurality of circular-ring grooves formed in an inside surface of the jacket, with each groove ending in a respective pair of the opposite slot-shaped gas-exit openings, and into which the openings of the barrel that lie in one plane terminate.

2. A gun barrel according to claim 1, wherein each of said pairs of gas-exit openings lies in a respective one of said planes.

3. The gun barrel according to claim 1, wherein the openings of adjacent planes are radially offset from one another.

4. The gun barrel according to claim 1, wherein the openings of the barrel are at least one of bores and slots.

5. The gun barrel according to claim 1, further comprising an annular stop formed on the outer surface of the barrel and against which a rear of the jacket tube is supported, and a screw ring provided on the muzzle end of the barrel and connected to the barrel to press the jacket tube against the stop to attach the jacket tube to the gun barrel.

6. The gun barrel according to claim 4, wherein the outside surface of the barrel and an inside surface of the jacket tube taper slightly in a conical fashion in a direction toward the muzzle of the barrel.

7. The gun barrel according to claim 1, wherein the openings of the barrel that terminate in a first one of the circular-ring grooves lie in only a first one of the planes, and the openings of the barrel that terminate in a second one of the circular-ring grooves lie in only a second one of the planes.

8. A gun barrel according to claim 7, wherein each of said pairs of gas-exit openings lies in a respective one of said planes.

9. The gun barrel according to claim 7, wherein the openings of adjacent planes are radially offset from one another.

10. The gun barrel according to claim 7, wherein the openings of the barrel are at least one of bores and slots.

11. The gun barrel according to claim 7, further comprising an annular stop formed on the outer surface of the barrel and against which a rear of the jacket tube is supported, and a screw ring provided on the muzzle end of the barrel and connected to the barrel to press the jacket tube against the stop to attach the jacket tube to the gun barrel.

12. The gun barrel according to claim 7, wherein the outside surface of the barrel and an inside surface of the jacket tube taper slightly in a conical fashion in a direction toward the muzzle of the barrel.

13. The gun barrel according to claim 1, wherein an outer surface of the muzzle region of the gun barrel contacts an inner surface of the jacket tube between each two adjacent circular-ring grooves.

14. A gun barrel according to claim 13, wherein each of said pairs of gas-exit openings lies in a respective one of said planes.

15. The gun barrel according to claim 13, wherein the openings of adjacent planes are radially offset from one another.

16. The gun barrel according to claim 13, wherein the openings of the barrel are at least one of bores and slots.

17. The gun barrel according to claim 13, further comprising an annular stop formed on the outer surface of the barrel and against which a rear of the jacket tube is supported, and a screw ring provided on the muzzle end of the barrel and connected to the barrel to press the jacket tube against the stop to attach the jacket tube to the gun barrel.

18. The gun barrel according to claim 13, wherein the outside surface of the barrel and an inside surface of the jacket tube taper slightly in a conical fashion in a direction toward the muzzle of the barrel.

* * * * *